US005367808A

United States Patent [19]

Liebman et al.

[11] Patent Number: 5,367,808

[45] Date of Patent: Nov. 29, 1994

[54] LOW POWER-CONSUMPTION SIGN-TURNER

[75] Inventors: Theodore E. Liebman, Philadelphia; Robert H. Levitt, Huntingdon Valley, both of Pa.

[73] Assignee: Decora Industry, Inc., Philadelphia, Pa.

[21] Appl. No.: 36,843

[22] Filed: Mar. 25, 1993

[51] Int. Cl.[5] ..... G09F 7/22

[52] U.S. Cl. ..... 40/617; 40/473; 248/343

[58] Field of Search ..... 40/617, 414, 430, 463, 40/466, 473; 248/343; 318/139, 432, 433, 811; 388/804, 811, 829, 831

[56] References Cited

U.S. PATENT DOCUMENTS

| | | | |
|---|---|---|---|
| 3,753,067 | 8/1973 | Milligan | 388/811 |
| 4,073,458 | 2/1978 | Sease | 248/340 |
| 4,759,140 | 7/1988 | Roberts et al. | 40/466 |
| 4,901,461 | 2/1990 | Edwards et al. | 40/463 X |
| 5,082,227 | 1/1992 | Insko | 248/343 |
| 5,146,702 | 9/1992 | Belokin, Jr. | 40/430 |

FOREIGN PATENT DOCUMENTS

| | | | |
|---|---|---|---|
| 1906968 | 8/1970 | Germany | 40/473 |
| 2839493 | 3/1980 | Germany | 40/473 |

*Primary Examiner*—Brian K. Green
*Attorney, Agent, or Firm*—Gregory J. Gore

[57] ABSTRACT

A battery-operated rotating sign employs a mechanically efficient speed-reducing mechanism and a power controller to reduce power consumption and, hence, increase battery life. The device is particularly suited to a ceiling-mounted, vertically-suspended rotating sign. A resilient power transmission strand extends from the vertical shaft of the motor to the sign which hangs from the bottom end of the strand. The power controller includes electrical circuitry having a timer which cycles between "on" and "off" periods. During the "on" period, the rapidly turning motor shaft winds up the resilient strand; and during the "off" period, the energy stored in the strand is released to the sign which turns slowly at the opposite end of the strand. Additional energy savings are provided by a photodetector circuit which disconnects the battery at night when operation of the sign is not desired. The apparatus further includes a device for mounting the motor to a suspended ceiling, including a mounting bracket which hangs from the ceiling tile cross bracing.

6 Claims, 3 Drawing Sheets

FIG. 3
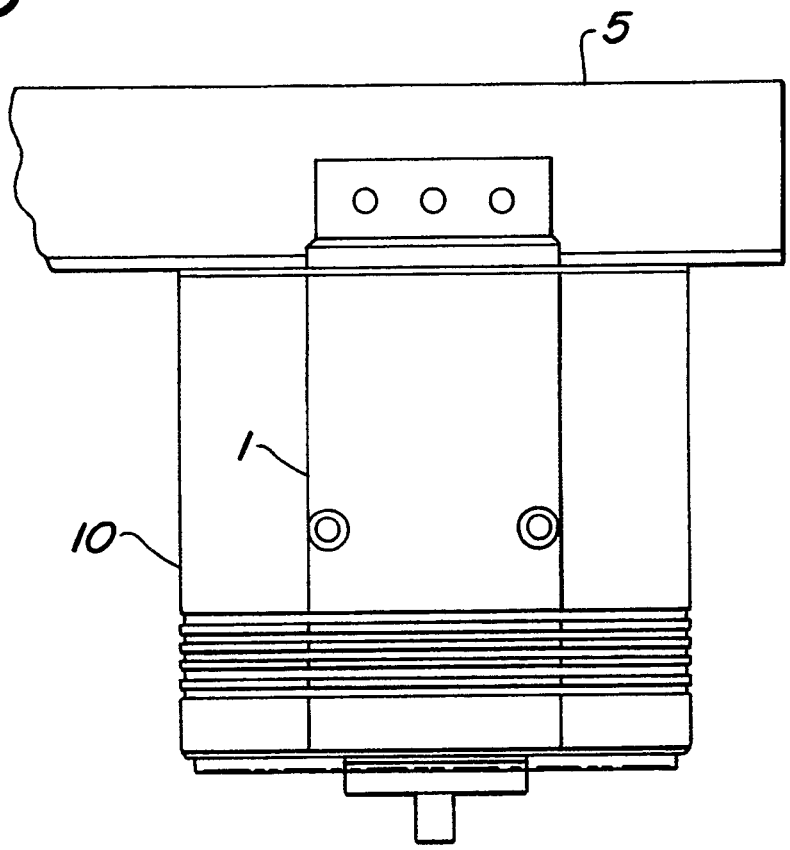
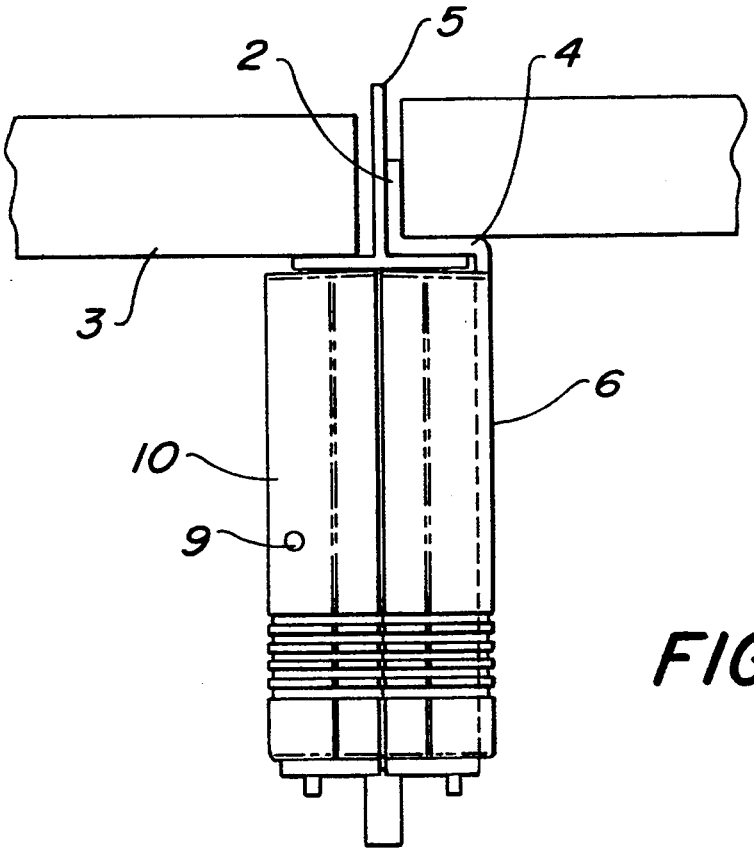
FIG. 4

LOW POWER-CONSUMPTION SIGN-TURNER

FIELD OF THE INVENTION

This invention relates to advertising signs, display signs, and mobiles. More specifically, the invention regards rotating advertising signs which include a mechanical linkage between the motor and the sign.

BACKGROUND OF THE INVENTION AND DESCRIPTION OF THE PRIOR ART

Motorized display signs are well-known and commonly found throughout the retail industry. These signs may be positioned on racks, counter tops, or suspended from the ceiling. The signs are turned at a very slow rate, usually about 3 RPM. To accomplish this, a gear-reducing mechanism is interposed between the motor and the sign. These motorized signs are usually battery-powered so that they may be moved and conveniently positioned anywhere in the retail store.

A problem exists, however, because the gear-type, speed-reducing mechanisms are extremely inefficient and, therefore, batteries must be replaced frequently. This creates the expense of a new battery when the replacement is made, and also difficulty in replacing the batteries of turning mechanisms which are difficult to reach, such as those which turn a hanging sign suspended from the ceiling of the store. There is, therefore, a need in the art to create motors and turning mechanisms which are more efficient, i.e. consume less energy. There is a further need for convenient means for suspending the motor and sign from the ceiling. In a retail establishment, there is often the need for changing the location of signs and there is therefore a further need for a ceiling sign-mounting system which is non-destructive to the ceiling and which can be easily moved and requires no additional hardware.

SUMMARY OF THE INVENTION

In order to solve the problems in the art described above, the present invention has been devised which employs an extremely simple and efficient mechanical linkage between the motor and the sign. This invention further includes electrical circuitry to compensate for low battery power conditions in order to maintain the sign turning rate at the proper speed. The invention employs a simple, resilient winding mechanism and an intermittent on/off motor controller which is responsive to battery power level. The preferred embodiment is a ceiling-mounted device which rotates a hanging sign suspended therefrom. No gearing is employed and, hence, average electrical current demand is reduced.

The invention includes a housing which surrounds the motor mechanism and power controller. The housing is mounted to the ceiling of the room in which the sign is to be displayed. The motor shaft extends from the bottom of the housing. A simple filament in the form of a single, or multiple strand connects the end of the motor shaft by way of a plastic cap which fits over the end. The bottom end of the filament is attached to the sign which is suspended therefrom. This strand travels between the motor and the sign and functions as a very efficient slow-release torsional spring. The strand provides the additional function of supporting the sign.

A controller includes motor drive electrical circuitry having a timer which cycles between "on" and "off" periods. During the "on" period, the motor shaft turns very rapidly for a small amount of time. As the motor turns, the power transmission strand is wound up because the force transmitted by the strand will not overcome the rotational inertia of the sign. Energy is stored in the mechanical resilience of the twisted strand material. The power transmission strand is preferably composed of a material having proper torsional stiffness to enhance the mechanical efficiency of the energy storage and release as described above. The motor is then turned "off" and the motor shaft lightly resists counter rotation by the residual magnetic force of the motor. By the spring action of the strand, the stored energy is then released by turning the suspended sign which hangs from the opposite end of the strand. In an alternate embodiment, two parallel strands may be employed in place of the single strand. This may be employed to provide additional turning force where required.

The on/off periods of each cycle are selected so that the sign rotates in a continuous manner as the power transmission strand is wound up by the motor and unwound by the spring action of the strand which causes the continuous turning of the sign. The invention further includes a power-compensation circuit within the motor controller which senses battery voltage and increases the "on" time within each operating cycle as the battery voltage level decreases. The power-compensation circuit ensures that the transmission strand is wound the same number of turns irrespective of battery power level changes. In this way, the sign rotates at the same speed as the battery loses power.

Additional energy savings are provided by a photodetector circuit mounted to the housing of the sign-turner which senses ambient light. The photodetector activates a switch which turns the power off at night when operation of the sign is not required. Preventing the sign from turning at night is also desirable since many store security systems will detect the motion of the sign and thus interfere with the normal operation of the security system.

Utilizing this system, great efficiencies have been observed. For example, a simple sign-turning mechanism which usually has a battery life of 2 months has been extended to 6 months, thus reducing the cost of operating the device. Furthermore, the quality of performance is also enhanced since the sign turns at the same speed, despite battery power loss.

The invention further includes novel means for mounting the motor to the ceiling. Most retail establishments include a modular "dropped" ceiling which comprises a plurality of rectangular panels which sit in a grid of cross bracing. The cross braces have an inverted T-shaped cross section. A Z-shaped motor mount bracket of the present invention has a top vertical leg, a middle horizontal leg, and a bottom vertical leg which is parallel to the top leg. The mounting bracket may be easily fitted along the edge of any ceiling panel by locating the top vertical leg of the bracket along the side edge of the tile. In this position, the horizontal leg of the bracket is held between the bottom of the tile and the horizontal support member of the cross brace. Thus, the bracket is held in place by the ceiling tiles and bracing without need for adhesive or fasteners of any type. Therefore, the mounting system is completely non-destructive and may easily be moved between locations.

Other objects and advantages will be readily understood by those of ordinary skill in the art from the following drawings and description of the preferred embodiment.

BRIEF DESCRIPTION OF THE DRAWINGS

FIG. 3 is a side view of the attachment bracket fitted against the ceiling cross bracing with the ceiling tile removed.

FIG. 4 is front view of the ceiling attachment bracket.

BRIEF DESCRIPTION OF THE PREFERRED EMBODIMENT

Figure 1:
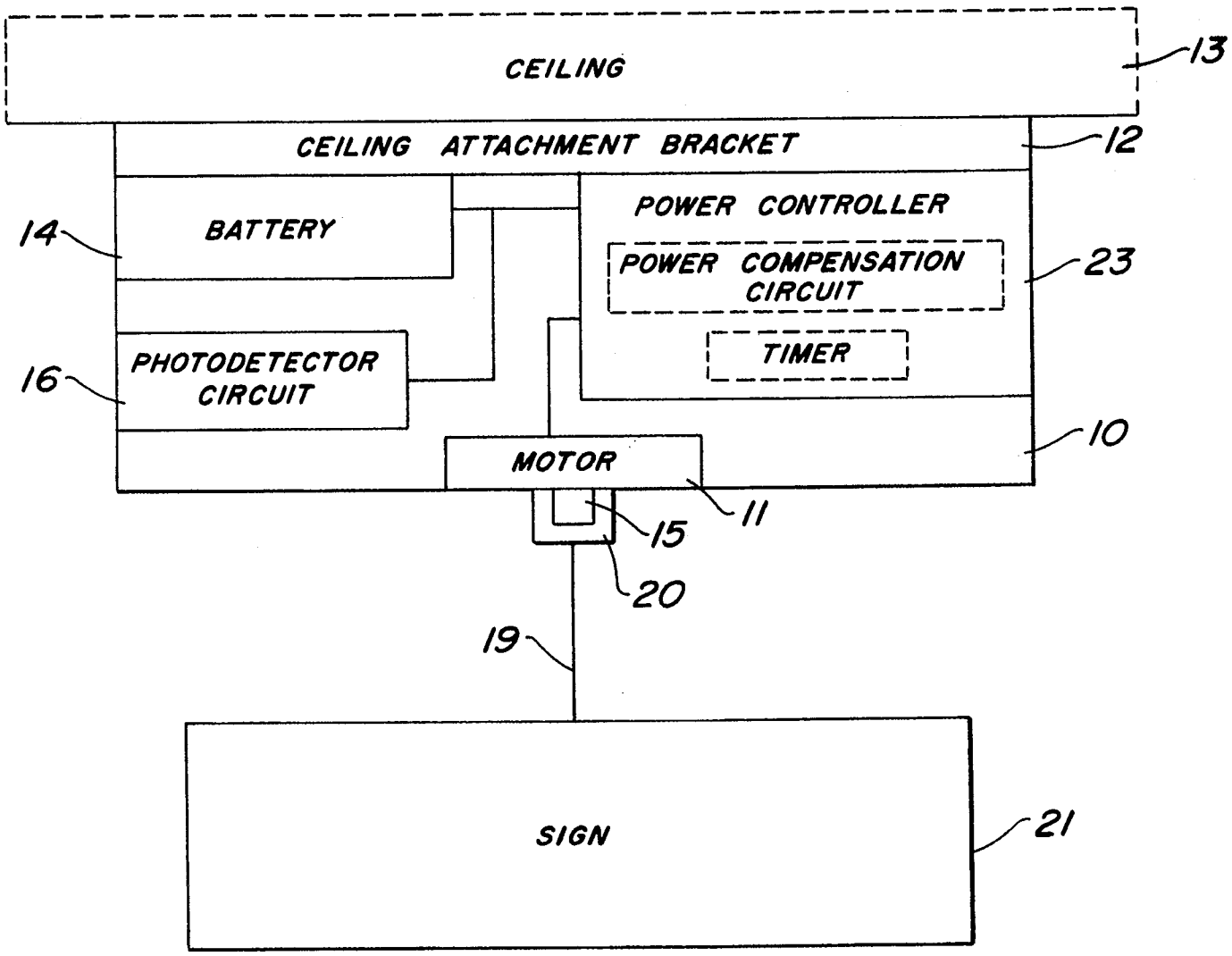
FIG. 1 is a diagrammatic representation of the present invention.

Referring now to FIG. 1, the present invention is depicted diagrammatically. Motor which is positioned within housing 10 is suspended from the ceiling 13 by way of bracket 12. Motor shaft 15 extends beyond the bottom of housing 10. One end of the power transmission strand 19 is connected to the end of the motor shaft by way of plastic connector cap 20. Sign 21 is affixed to the opposite end of the strand. A photodetector circuit 16 is positioned against the outer wall of the housing and detects ambient light. The photodetector circuit interrupts power from a battery 14 when the amount of detected ambient light drops below a minimum level. The housing also includes a power controller 23, which is connected between a battery and the motor, and which includes both a power compensation circuit and a timer which are more fully described with reference to FIG. 2.

In operation, a short pulse of electrical energy turns the motor shaft 15 rapidly, which twists the power transmission strand. As described above, this stored energy is then gradually released to the slower turning sign suspended therefrom. Preferably the power strand is a polyester filament, such as Mylar(R), which has a selected torsional stiffness suitable for the weight and speed that the sign is to be turned.

Figure 2:
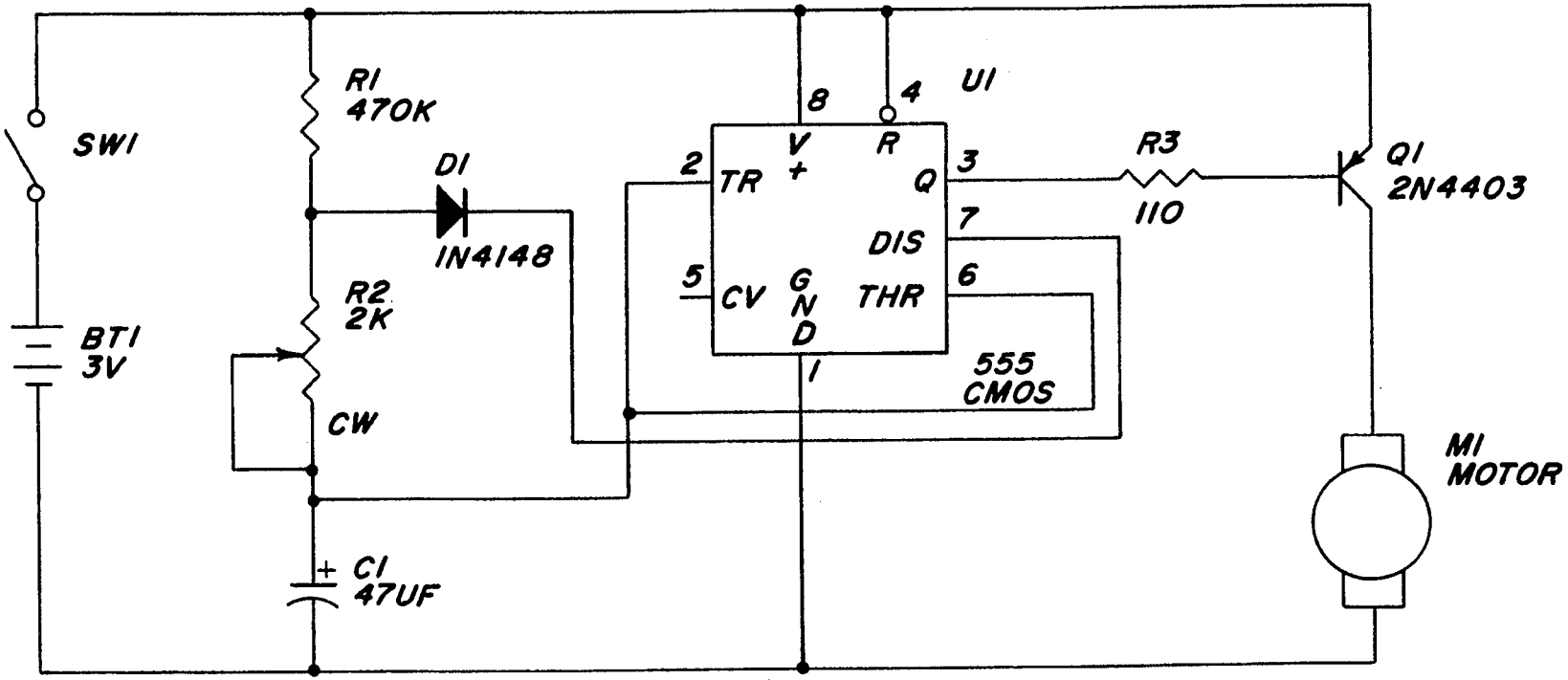
FIG. 2 is a schematic diagram of the power controller.

Referring to FIG. 2, a circuit diagram of the power controller is shown. The circuit consists of a power source, B1 (typically a 3 V battery); an oscillator, consisting of components U1, R1, R2, C1, and D1; and a power switch, consisting of R3 and Q1. The output of Q1 drives motor 11 that winds the strand as shown in FIG. 1. U1 is a low power version of the "555" timer, an electrical timer circuit well-known in the electrical arts of the type manufactured by Texas Instruments Corporation. The oscillator duty cycle is such that a very short pulse of power causes the motor to turn only a few revolutions. The power pulses occur a few times per minute.

The values of R1, R2 and C1 in the circuit shown in FIG. 2 are selected to give the desired rotational speed to the turning sign by altering the "on" and "off" periods of the operating cycle. Variable resistor R2 and C1 determines the "on" time within a cycle, and resistors R1+R2 and C1 determine the cycle period. By adjusting resistor R2, the speed of the rotation of the sign can be regulated. These values are typically selected through trial and error, and depend upon the size of the motor, the length and gauge of the Mylar(R) power transmission strand, and the size of the sign used in each case. Using the component values shown in FIG. 2, a total cycle time of 15 seconds with an "on" time of 30 milliseconds is observed. Using a transmission strand, 12-inches in length, will provide a steady turning rate of approximately 6 RPM. Power savings are also achieved by limiting the operation of the motor mechanism to daytime only. This is accomplished by a photodetector circuit 16 well-known in the arts which senses ambient light in the area of the motor housing. The photodetector circuit disconnects the battery when the amount of ambient light detected by a photocell drops below a minimum level.

The astable oscillator circuit may include low power compensation. Diode D1 compensates for a drop in voltage in B1. As battery B1 voltage drops, it causes a wider pulse of current (longer time) to motor M1, thereby extending the "on" period. In this way, the number of motor revolutions per cycle is substantially independent of the voltage level.

FIG. 3 shows a side view of the motor housing and attachment bracket 1 with the ceiling tile removed. The attachment bracket is fitted between the edge of the ceiling tile and the vertical leg of the inverted T-molding 5 which is of the type conventionally used in a suspended ceiling or "drop" ceiling. The attachment bracket rests against the horizontal portion of the T-molding cross bracing and motor housing 10 is affixed to the bracket directly by fasteners, or may be otherwise suspended therefrom by any convenient method.

Referring now to FIG. 4, a cross-sectional view of the attachment bracket is shown. The bracket includes three legs which meet at right angles; a top vertical leg 2, a middle horizontal leg 4, and a bottom vertical leg 6 which is parallel to the top leg. As shown in this figure, the bracket is fitted between the ceiling panel 3 and the ceiling T-molding cross bracing 5. Housing 10 is affixed to the bracket. With the upper vertical leg and middle horizontal leg seated between the ceiling panel and the cross bracing as shown in this drawing, it will be readily understood that this configuration results in a self-supporting system and no separate fasteners are required. Thus, the mounting bracket is non-destructive to elements of the ceiling and may easily be moved between locations. The motor housing 10 is attached to the bottom leg by any means conveniently available. Aperture 9 allows ambient light to strike a photocell which is part of the photodetector circuit (not shown) mounted to the inside of housing 10.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A display sign-turner, comprising:

a housing;

a motor powered by a battery, said battery and motor mounted to said housing, said motor having an output shaft for turning a sign;

a power controller connected between said battery and said motor, said controller including an electrical timer circuit which provides intermittent power to said motor in alternating "on" and "off" periods producing successive unidirectional operating cycles;

resilient means which transmit power from the motor to the sign, said means having opposite ends connected between the output shaft of the motor at one end and to the sign at a second end; and a continuously rotating sign connected to the second end of said resilient means, said resilient means storing energy during the "on" period of the operating cycle, and said resilient means releasing energy during the "off" period, such that intermittent turning of the one end of the resilient means is translated into the continuous rotation of the sign.

2. The sign-turner of claim 1, wherein the sign is suspended from the resilient means.

3. The sign-turner of claim 2, further including an attachment bracket connected to the motor, said bracket having three legs: a top vertical leg, a middle horizontal leg, and a lower vertical leg which is parallel to the top leg, said middle horizontal leg for fitting against a horizontal support of a ceiling cross brace.

4. The sign-turner of claim 1, wherein said power controller further includes electrical circuit means responsive to a power level of said battery, and said electrical circuit means increases the "on" period the operating cycle of said motor relative to the "off" period as the power of the battery decreases, maintaining the rotational speed of the sign despite a decrease in power from the battery.

5. The sign-turner of claim 4, further including a photodetector circuit connected to said battery such that said battery is electrically disconnected from said power controller and said motor when the amount of ambient light around said sign-turner drops below a minimum level.

6. The sign-turner of claim 1, further described in that said resilient means is a strand of a polyester monofilament.

* * * * *